US005201211A

United States Patent [19]

Golembreski

[11] Patent Number: 5,201,211

[45] Date of Patent: Apr. 13, 1993

[54] SHEET METAL PULLING APPARATUS

[76] Inventor: Anthony G. Golembreski, 51 Eckel Rd., Little Ferry, N.J. 07643

[21] Appl. No.: 791,342

[22] Filed: Nov. 14, 1991

[51] Int. Cl.[5] ..... B21D 1/12

[52] U.S. Cl. ..... 72/463; 72/705

[58] Field of Search ..... 72/463, 705, 457; 76/108.6

[56] References Cited

U.S. PATENT DOCUMENTS

| | | | |
|---|---|---|---|
| 3,555,935 | 1/1971 | Dorrenberg | 76/108.6 |
| 3,744,291 | 7/1973 | Hagerty et al. | 72/105 |
| 4,037,448 | 7/1977 | Di Maio et al. | 72/705 |
| 4,050,271 | 9/1977 | Jones | 72/705 |

*Primary Examiner*—Lowell A. Larson
*Attorney, Agent, or Firm*—Leon Gilden

[57] ABSTRACT

A pulling apparatus including a pulling head is arranged for reception of a slide hammer within a third bore thereof, wherein a first and second bore receives a respective shank and head of an associated fastener bolt, wherein the fastener bolt is directed through a sheet metal panel to be pulled. The second bore may be formed of a hexagonal configuration to complimentarily receive the head therewithin, and wherein the side wall of the pulling head is arranged with wrench flats to permit rotation of the screw head and pulling head in a unitary manner for projection of the screw shank into an associated sheet metal panel.

1 Claim, 4 Drawing Sheets

SHEET METAL PULLING APPARATUS

BACKGROUND OF THE INVENTION

1. Field of the Invention

The field of invention relates to sheet metal pulling apparatus, and more particularly pertains to a new and improved sheet metal pulling apparatus wherein the same is arranged for the convenient mounting of the apparatus to an associated sheet metal panel to be pulled or relieved of a dent configuration.

2. Description of the prior Art

Various sheet metal tools are utilized throughout the prior art such as exemplified in automotive body repair. Such tools are exemplified in U.S. Pat. No. 4,072,042 to Servin illustrating the typical prior art slide hammer arrangement.

U.S. Pat. No. 4,748,842 to Dingman sets forth a sheet metal pulling apparatus utilizing a winch structure.

U.S. Pat. No. 4,653,167 to Mullins sets forth a rotary tool for projection into a sheet metal panel for mounting the tool relative to the sheet metal panel for a subsequent pulling operation.

As such, it may be appreciated that there continues to be a need for a new and improved sheet metal pulling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of sheet metal pulling apparatus now present in the prior art, the present invention provides a sheet metal pulling apparatus wherein the same is arranged for mounting to an associated sheet metal panel to permit selective pulling of the panel in a panel repair structure. As such, the general purpose of the present invention, which will be described subsequently in greater detail, is to provide a new and improved sheet metal pulling apparatus which has all the advantages of the prior art sheet metal pulling apparatus and none of the disadvantages.

To attain this, the present invention provides a pulling apparatus including a pulling head arranged for reception of a slide hammer within a third bore thereof, wherein a first and second bore receives a respective shank and head of an associated fastener bolt, wherein the fastener bolt is directed through a sheet metal panel to be pulled. The second bore may be formed of a hexagonal configuration to complimentarily receive the head therewithin, and wherein the side wall of the pulling head is arranged with wrench flats to permit rotation of the screw head and pulling head in a unitary manner for projection of the screw shank into an associated sheet metal panel.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sheet metal pulling apparatus which has all the advantages of the prior art sheet metal pulling apparatus and none of the disadvantages.

It is another object of the present invention to provide a new and improved sheet metal pulling apparatus which may be easily and efficiently manufactured and marketed.

It is a further object of the present invention to provide a new and improved sheet metal pulling apparatus which is of a durable and reliable construction.

An even further object of the present invention is to provide a new and improved sheet metal pulling apparatus which is susceptible of a low cost of manufacture with regard to both materials and labor, and which accordingly is then susceptible of low prices of sale to the consuming public, thereby making such sheet metal pulling apparatus economically available to the buying public.

Still Yet another object of the present invention is to provide a new and improved sheet metal pulling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
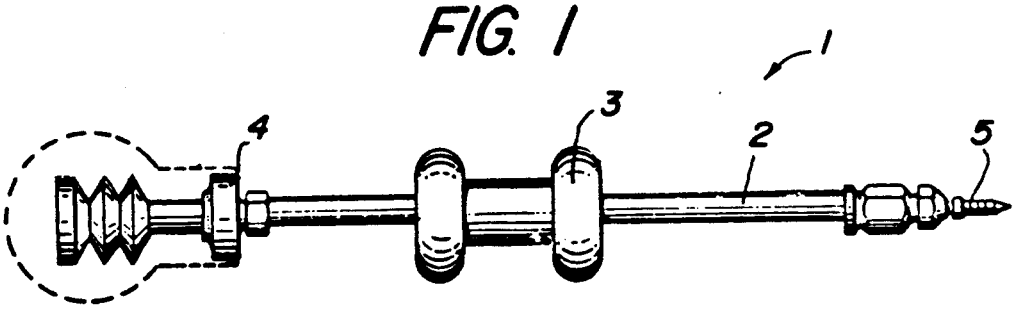
FIG. 1 is an orthographic side view of a prior art sheet metal slide hammer arrangement.
Figure 2:
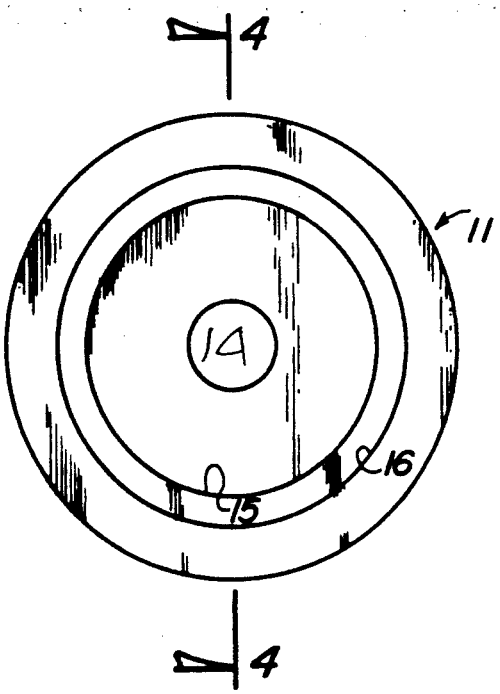
PRIOR ART FIG. 2
FIG. 2 is an orthographic top view of the pulley head utilized by the invention.
Figure 3:
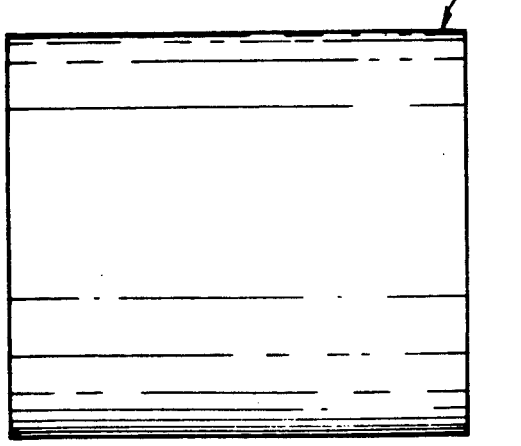
FIG. 3 is an orthographic side view of the pulley head utilized by the invention.
Figure 4:
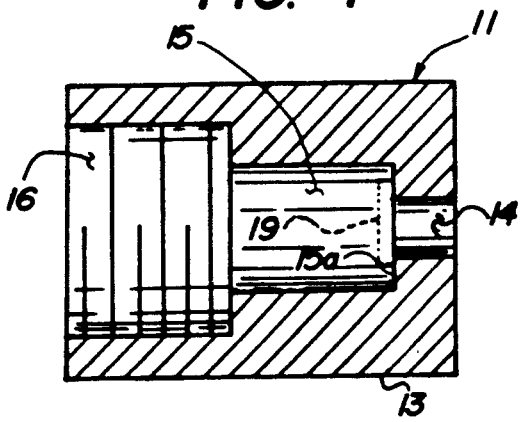
FIG. 4 is an orthographic view, taken along the lines 4—4 of FIG. 2 in the direction indicated by the arrows.
Figure 5:
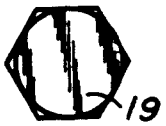
FIG. 5 is an orthographic top view of the screw member utilized by the invention.
Figure 6:
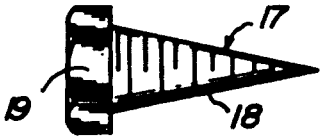
FIG. 6 is an orthographic side view of the screw member utilized by the invention.
Figure 7:
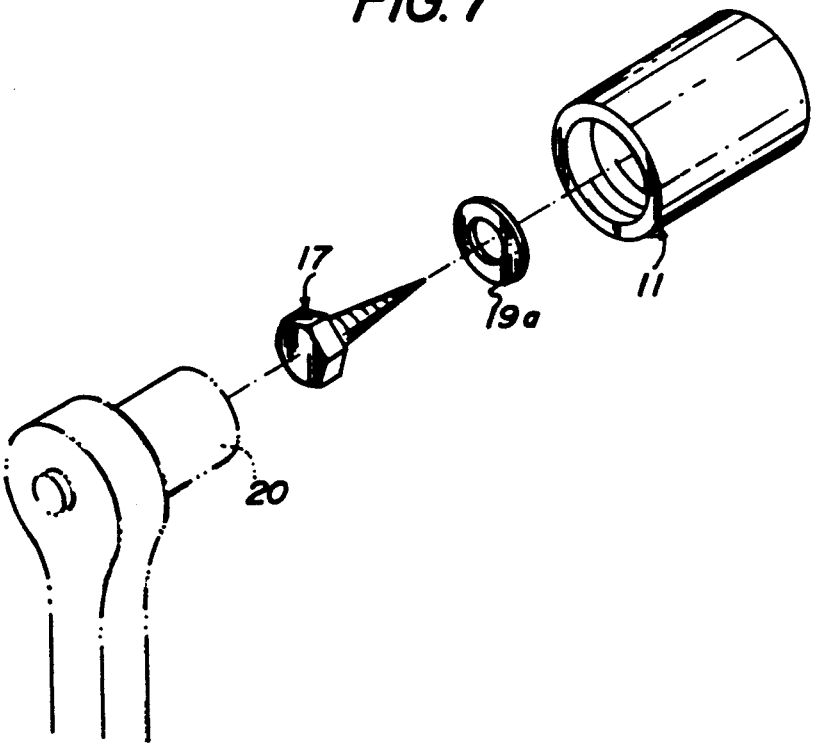
FIG. 7 is an isometric illustration of the screw member and pulling head for use relative to one another.

With reference now to the drawings, and in particular to FIGS. 1 to 16 thereof, a new and improved sheet metal pulling apparatus embodying the principles and concepts of the present invention and generally designated by the reference numerals 11-28 will be described.

More specifically, the prior art structure, such as illustrated in FIG. 1 and exemplified in the U.S. Pat. No. 4,072,042, illustrates a prior art hammer 1 to include a side shaft 2 including a shaft weight 3 slidably mounted thereon for abutment with an abutment plate 4 integrally and orthogonally mounted to a rear terminal end of the slide shaft 2, with a threaded boss 5 mounted to a forward distal end of the slide shaft, wherein the threaded boss 5 is of a typical prior art slide hammer for use with the pulling head 11, such as exemplified by the instant invention.

The pulling head 11 of the invention includes a pulling head front wall 12 and a pulling head side wall 13. A first bore 14 is coaxially directed through the pulling head through the front wall 12 and defined by a first diameter. A second bore 15 adjacent the first bore defined by a second diameter is greater than the first diameter, and a third internally threaded bore 16 projects from the second bore 15 exteriorly through a rear distal end of the pulling head 11 spaced from the front wall 12, wherein the third diameter is greater than the second diameter, as illustrated. A screw member 17 is formed with a screw member externally threaded shank 18 slidably directed through the first bore 14 and including a screw member head 19 received within the second bore 15 permitting reception of a fastener socket 20 thereabout for rotation of the screw member 17 for projection within a sheet metal panel (not illustrated). If required, a torroidal washer plate 19*a* may be mounted between the head 19 and a bottom wall 15*a* of the second bore 15. As illustrated, the bottom wall 15*a* is orthogonally oriented relative to an axis defined by the pulling head 11 and as illustrated, the first, second, and third bores are coaxially aligned along said axis. Further, the front wall 12 is oriented parallel relative to the bottom wall 15*a*.

Figure 8:
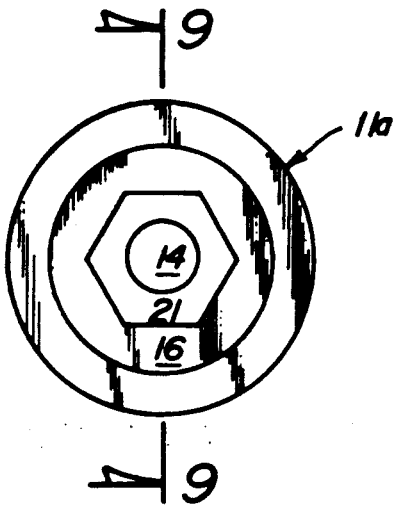
FIG. 8 is an orthographic top view of a modified pulling head structure.
Figure 9:
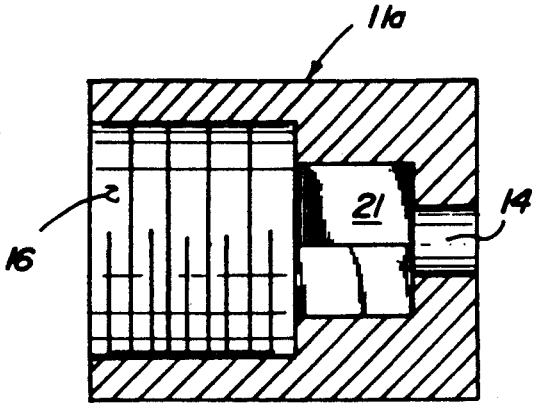
FIG. 9 is an orthographic side view, taken along the lines 9—9 of FIG. 8 in the direction indicated by the arrows.
Figure 10:
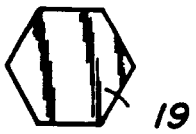
FIG. 10 is an orthographic top view of the screw member utilized by the pulling head of FIGS. 8 and 9.
Figure 11:
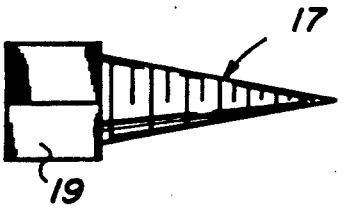
FIG. 11 is an orthographic side view of the screw member, as set forth in FIG. 10.
Figure 12:
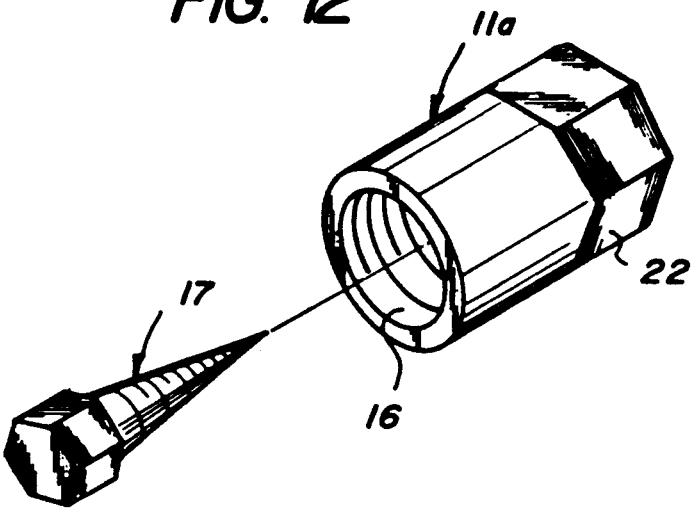
FIG. 12 is an isometric exploded illustration of the screw member and pulling head utilized in combination.
Figure 13:
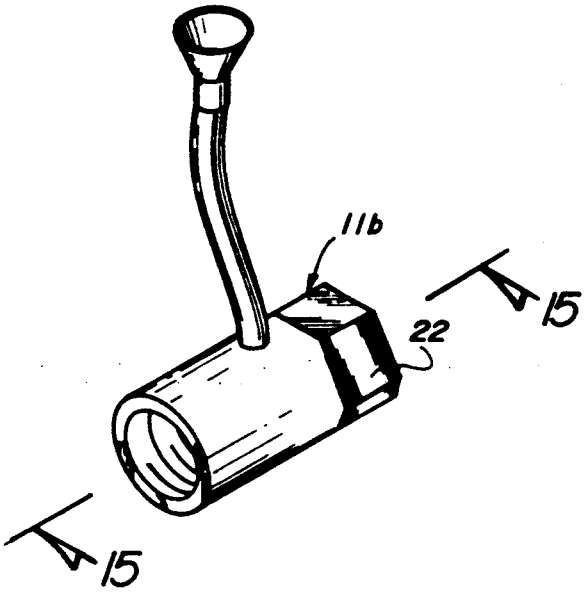
FIG. 13 is an isometric illustration of further modified pulling head structure.

The FIGS. 8, 9, and 12 illustrate a modified pulling head 11*a*, including a hexagonal second bore 21 in lieu of the second bore 15, wherein the hexagonal bore 21 is defined by a hexagonal bore width greater than the first diameter and less than the third diameter, in a manner similar to the pulling head 11. The modified pulling head 11*a* further includes wrench flats 22 formed about the side wall 13. The screw member 17 includes a head diameter substantially equal to the hexagonal bore width 21 complimentarily received therewithin, whereupon nesting of the screw member hexagonal head 19 within the hexagonal bore 21 permits rotation of the screw member 17 upon rotation of the pulling head 11 by the wrench flats 22. As noted, the threaded boss 5 of the prior art hammer 1 is typically threadedly received within the third bore 16, whereupon projection of the adapter head and screw member within an associated sheet metal panel, the slide shaft weight 3 is slid relative to the slide shaft 2 and upon impact with the abutment plate 4, impacting force is directed coaxially and rearwardly of the threaded boss 5 in conventional use.

Figure 14:
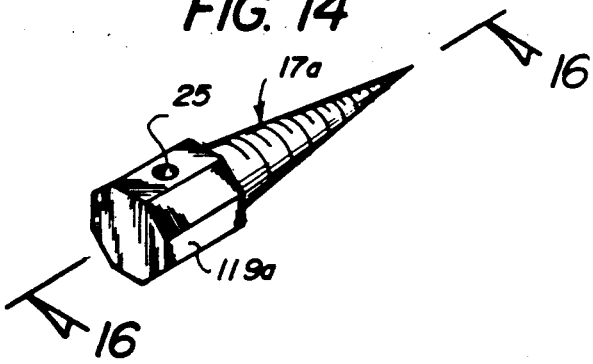
FIG. 14 is an isometric illustration of a further modified sheet metal screw.
Figure 15:
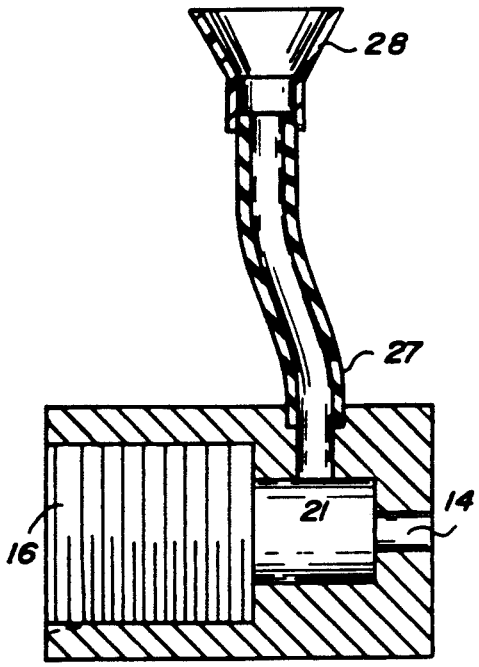
FIG. 15 is an orthographic view, taken along the lines 15—15 of FIG. 13 in the direction indicated by the arrows.
Figure 16:
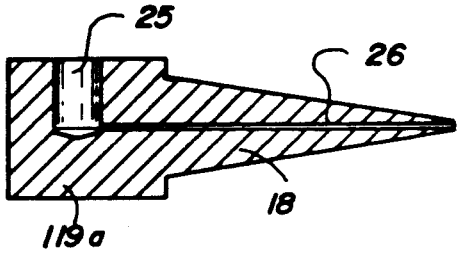
FIG. 16 is an orthographic view, taken along the lines 16—16 of FIG. 14 in the direction indicated by the arrows.

The further modified screw member 17*a*, such as illustrated in FIG. 14, includes a modified head 119*a* that is formed with a first fluid conduit 25 in fluid communication with the second fluid conduit 26 that is coaxially directed through the screw member 18 projecting from a forward end thereof, whereupon positioning of the modified screw member head 119*a* within the hexagonal bore 21 aligns the first fluid conduit 25 with a screw member flexible fluid conduit 27. The flexible fluid conduit 27 is in fluid communication thereby with the first and second fluid conduits 25 and 26, whereupon a funnel 28 mounted to an upper terminal end of the flexible fluid conduit 27 permits the protection of rust inhibitor and the like to an interior surface of a sheet metal panel to be pulled permitting the additional protection of corrosion inhibitor and the like relative to a sheet metal panel to minimize further damage to the sheet metal panel thusly being worked by the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sheet metal pulling apparatus in combination with a slide hammer, wherein the slide hammer includes a slide shaft and a slide weight slidably mounted upon the slide shaft, and the slide shaft including an abutment at a rear distal end of the slide shaft, and a threaded boss at a forward distal end of the slide shaft, and wherein the apparatus further comprises, a pulling head, the pulling head including a front wall and a generally cylindrical side wall defined about a predetermined axis, wherein the front wall is orthogonally oriented relative to the predetermined axis, and a first bore directed through the front wall defined by a first diameter, and a second bore adjacent the first bore defined by a second diameter greater than the first diameter, and an internally threaded third bore defined by a third diameter greater than the second diameter, wherein the third bore projects from the second diameter to a rear distal end of the pulling head spaced from the front wall, and the third internally threaded bore is arranged for threaded reception of the threaded boss, and a screw member, the screw member including an externally threaded shank slidably directed through the first bore, and a screw member head, wherein the screw member head is received within the second bore, and the screw head is of a generally hexagonal configuration, and the second bore defines a hexagonal bore, and wherein the hexagonal bore is defined by the second diameter and the screw member head is defined by the second diameter, and the pulling head side wall includes a plurality of wrench flat surfaces formed about the side wall to effect simultaneous rotation of the pulling head and the screw member upon rotation of the pulling head, and the screw member head includes a first fluid conduit directed into the screw member head, and the screw member includes a second fluid conduit in fluid communication with the first fluid conduit directed through a forward distal end of the screw member shank, and the pulling head includes a flexible fluid conduit directed through the side wall in communication with the first fluid conduit when the screw member head is positioned within the second bore, and the flexible fluid conduit includes a funnel formed at an upper distal end of the flexible fluid conduit to receive an anti-corrosive fluid through the flexible fluid conduit to direct the fluid through the first fluid conduit and the second fluid conduit forwardly of the screw member.

* * * * *